US010680333B2

(12) United States Patent
Sasaki et al.

(10) Patent No.: US 10,680,333 B2
(45) Date of Patent: Jun. 9, 2020

(54) LOOP ANTENNA

(71) Applicant: Nippon Telegraph and Telephone Corporation, Tokyo (JP)

(72) Inventors: Ai-ichiro Sasaki, Atsugi (JP); Tsutomu Mizota, Atsugi (JP); Hiroki Morimura, Atsugi (JP); Osamu Kagami, Atsugi (JP)

(73) Assignee: Nippon Telegraph and Telephone Corporation (JP)

( * ) Notice: Subject to any disclaimer, the term of this patent is extended or adjusted under 35 U.S.C. 154(b) by 22 days.

(21) Appl. No.: 15/542,338

(22) PCT Filed: Mar. 7, 2016

(86) PCT No.: PCT/JP2016/057011
§ 371 (c)(1),
(2) Date: Jul. 7, 2017

(87) PCT Pub. No.: WO2016/147934
PCT Pub. Date: Sep. 22, 2016

(65) Prior Publication Data

US 2018/0277953 A1 Sep. 27, 2018

(30) Foreign Application Priority Data

Mar. 18, 2015 (JP) ..... 2015-054362

(51) Int. Cl.
*H01Q 7/00* (2006.01)
*H01Q 1/38* (2006.01)

(52) U.S. Cl.
CPC ..... *H01Q 7/00* (2013.01); *H01Q 1/38* (2013.01)

(58) Field of Classification Search
CPC ..... H01Q 7/00
See application file for complete search history.

(56) References Cited

U.S. PATENT DOCUMENTS 4,395,714 A * 7/1983 Takeda ..... H01Q 7/00 343/701
6,020,856 A 2/2000 Alicot
(Continued)

FOREIGN PATENT DOCUMENTS

JP 2001-185939 A 7/2001
JP 2001185939 A * 7/2001 ..... H01Q 7/00
(Continued)

OTHER PUBLICATIONS

Lee et al., "Enhanced Loop Structure of NFC Antenna for Mobile Handset Applications, Hindawi Publishing Corporation International Journal of Antennas and Propagation vol. 2014, Article ID 187029" (Year: 2014).*
(Continued)

*Primary Examiner* — Hai V Tran
*Assistant Examiner* — Bamidele A Jegede
(74) *Attorney, Agent, or Firm* — Kilpatrick Townsend & Stockton LLP

(57) ABSTRACT

Provided is a loop antenna which can contribute to an increase of an area of a radio system using a magnetic field. The loop antenna includes a main loop 1 which is an open loop connected to a signal source 5 or a reception circuit; and an amplification loop 2 which is a closed loop having the same shape as the main loop 1. The main loop 1 and the amplification loop 2 are arranged on a same surface of a flat substrate formed of an insulator. A first capacitance is connected to the main loop 1, and a second capacitance is connected to the amplification loop.

9 Claims, 4 Drawing Sheets

(56) References Cited

U.S. PATENT DOCUMENTS

| | | | | |
|---|---|---|---|---|
| 6,567,050 | B1 * | 5/2003 | Briggs | H01Q 1/2216 343/741 |
| 2002/0113739 | A1 * | 8/2002 | Howard | H01Q 1/243 343/702 |
| 2005/0057422 | A1 * | 3/2005 | Deguchi | G06K 7/10178 343/867 |
| 2005/0092845 | A1 * | 5/2005 | Forster | G06K 19/07749 235/492 |
| 2010/0187913 | A1 * | 7/2010 | Smith | H02J 5/005 307/104 |
| 2010/0253587 | A1 * | 10/2010 | Lindenmeier | H01Q 7/00 343/797 |
| 2011/0115607 | A1 * | 5/2011 | Deguchi | H01Q 7/00 340/10.1 |
| 2011/0281535 | A1 * | 11/2011 | Low | H02J 50/12 455/129 |
| 2012/0094599 | A1 * | 4/2012 | Takeyama | H01Q 1/243 455/41.1 |
| 2012/0208474 | A1 * | 8/2012 | Deguchi | G06K 7/10336 455/90.2 |
| 2013/0057080 | A1 | 3/2013 | Smith et al. | |
| 2013/0194540 | A1 * | 8/2013 | Pugh | H01Q 1/22 351/159.03 |
| 2013/0328409 | A1 * | 12/2013 | Georgakopoulos | H01F 7/006 307/104 |
| 2014/0266966 | A1 * | 9/2014 | Rivera | H01Q 7/00 343/867 |
| 2017/0207535 | A1 * | 7/2017 | Tsukuda | H01Q 7/00 |

FOREIGN PATENT DOCUMENTS

| | | | | |
|---|---|---|---|---|
| JP | 2005-102101 | A | 4/2005 | |
| JP | 2005-275871 | A | 10/2005 | |
| JP | 2011-045045 | A | 3/2011 | |
| JP | 2011045045 | A * | 3/2011 | H01Q 7/00 |
| JP | 2011-086009 | A | 4/2011 | |
| JP | 2013-125991 | A | 6/2013 | |
| JP | 2013-534074 | A | 8/2013 | |
| JP | 2014-135538 | A | 7/2014 | |
| JP | 2014-135539 | A | 7/2014 | |
| WO | 2015/008704 | A1 | 1/2015 | |

OTHER PUBLICATIONS

Li et al., "Investigation of Circularly Polarized Loop Antennas With a Parasitic Element for Bandwidth Enhancement, IEEE Transactions on Antennas and Propagation, vol. 53, No. 12, Dec. 2005" (Year: 2005).*

International Preliminary Report on Patentability, PCT Patent Application No. PCT/JP2016/057011 dated Sep. 28, 2017.

International Search Report, PCT Patent Application No. PCT/JP2016/057011, dated May 10, 2016.

Office Action, Japanese Patent Application No. 2015-054362, dated May 10, 2016.

Office Action, Japanese Patent Application No. 2015-054362, dated Sep. 13, 2016.

Supplementary European Search Report, European Patent Application No. 16764764.3, dated Aug. 28, 2018.

Office Action, European Patent Application No. 16764764.3, dated Oct. 17, 2019, 6 pages.

Office Action, Chinese Patent Application No. 201680015874.1, dated Apr. 28, 2019, 17 pages.

Office Action, European Patent Application No. 16764764.3, dated May 8, 2019, 6 pages.

* cited by examiner

FOURTH EMBODIMENT

LOOP ANTENNA

This application is a national stage application of PCT/JP2016/057011, which claims priority to Japanese Application No. 2015-054362, both of which are incorporated herein by reference.

TECHNICAL FIELD

The present invention relates to a loop antenna which can contribute to an increase of an area of a radio system using a magnetic field.

BACKGROUND ART

A radio system utilizing a magnetic field has been conventionally proposed. Unlike radio waves, the magnetic field hardly interacts with human bodies and dielectric materials, and is thus advantageous in forming a definite radio area which is undisrupted by human bodies and obstacles. Moreover, the distance attenuation characteristic of a radio wave is 20 dB/dec., while the distance attenuation characteristic of a magnetic field is 60 dB/dec. Thus, the magnetic field is suitable in the case of definitely defining a radio area boundary.

PRIOR ART DOCUMENT

Patent Document

PATENT DOCUMENT 1: Japanese Patent Application Publication No. 2013-125991

PATENT DOCUMENT 2: Japanese Patent Application Publication No. 2014-135538

PATENT DOCUMENT 3: Japanese Patent Application Publication No. 2014-135539

SUMMARY OF THE INVENTION

Problem to be Solved by the Invention

However, the distance attenuation characteristic (60 dB/dec.) of the magnetic field which is steeper than that of the radio wave is a disadvantageous factor in the case of increasing the radio area. Conventionally, in order to increase the area of the radio system using the magnetic field, a current supplied from a transmitter has to be increased.

The present invention has been made in view of the problems described above and an objective thereof is to provide a loop antenna which can contribute to an increase of an area of a radio system using a magnetic field.

Means for Solving the Problem

In order to solve the problems described above, a loop antenna in a first aspect of the present invention includes a main loop which is an open loop connected to a signal source or a reception circuit; and an amplification loop which is a closed loop having a same shape as the main loop, and the main loop and the amplification loop are arranged on a same surface of a flat substrate formed of an insulator.

A loop antenna in a second aspect of the present invention includes: a main loop which is an open loop connected to a signal source or a reception circuit; and an amplification loop which is a closed loop having a same shape as the main loop, and the main loop and the amplification loop are arranged on different surfaces of a flat substrate formed of an insulator or on different flat substrates in a structure in which a plurality of flat substrates are stacked one on top of another.

Effect of the Invention

In the loop antenna of the present invention, in the case where the signal source is used, a current sufficiently larger than a current flowing through the main loop can be accumulated in the amplification loop. As a result, a large magnetic field can be generated.

In the loop antenna of the present invention, in the case where the reception circuit is used, an effect in which a large current is accumulated in the amplification loop in the reception of the magnetic field allows the main loop to receive a reception current larger than that in the case where no amplification loop is used.

As result, the loop antenna of the present invention can contribute to an increase of an area of a radio system using a magnetic field.

MODE FOR CARRYING OUT THE INVENTION

Embodiments of the present invention are described below with reference to the drawings.

First Embodiment

Figure 1:
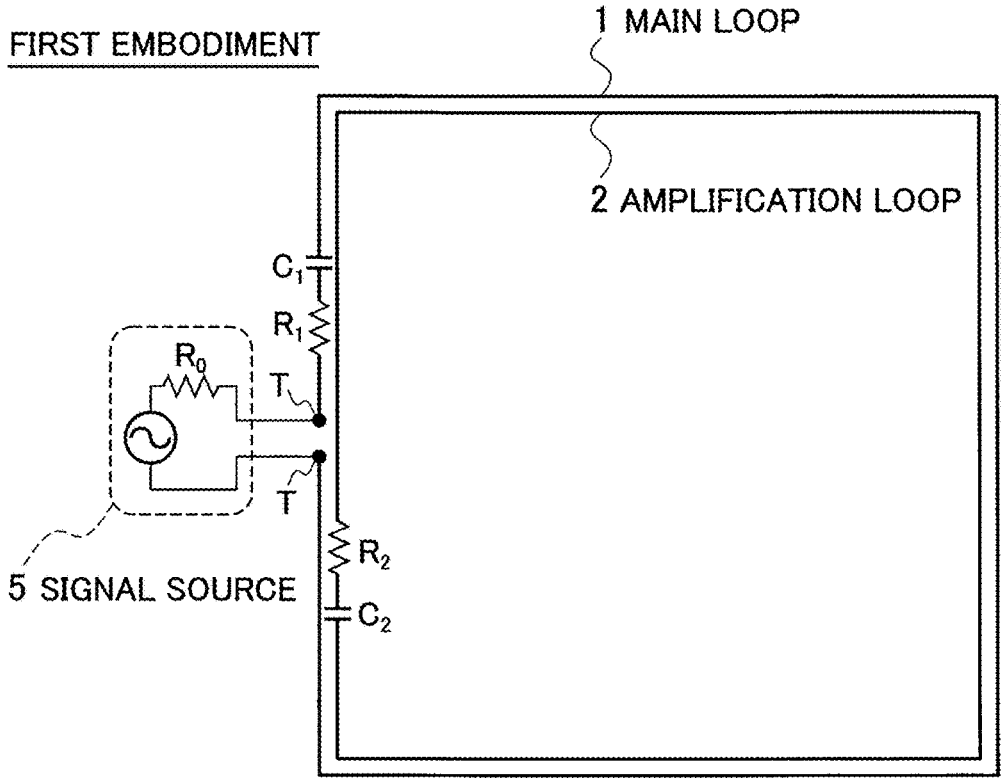
FIG. 1 is a diagram illustrating an example of a loop antenna in a first embodiment.

FIG. 1 is a diagram illustrating an example of a loop antenna in a first embodiment.

The loop antenna is a resonant loop antenna and includes a main loop 1 and an amplification loop 2.

The main loop 1 is formed on a flat substrate (not illustrated) formed of an insulator, includes terminals T, T for connection to a signal source 5 or a reception circuit (not illustrated), and is an open loop. The number of turns is one. FIG. 1 is a diagram of an example in which the signal source 5 is connected to the main loop 1. A resistance R1 and a capacitance C1 are connected to the main loop 1 in series.

The amplification loop 2 is formed very close to the main loop 1, on the same surface of the flat substrate on which the main loop 1 is formed. The amplification loop 2 includes no terminals and is a closed loop. The number of turns is one. The amplification loop 2 is arranged inside the main loop 1.

The distance d between the main loop 1 and the amplification loop 2 is, for example, equal to or smaller than one-tenth of a square root of the area of a region surrounded by the main loop 1 or the amplification loop 2. A resistance R2 and a capacitance C2 are connected to the amplification loop 2 in series.

When an alternating current (AC current) I1 is supplied from the signal source 5 to the main loop 1, mutual inductance between the main loop 1 and the amplification loop 2 causes an AC current I2 to flow through the amplification loop 2. Generally, when R2 is smaller than R1, I2 is larger than I1. An area of a magnetic field generated by the loop antenna can be thus increased.

I2 depends on multiple factors such as a frequency, R1, R2, C1, C2, an internal resistance R0 of the signal source 5, and the shape of the loop. Accordingly, it is desirable to maximize I2 by adjusting R1, R2, C1, and C2.

Note that, although FIG. 1 illustrates an example in which the loop antenna is connected to the signal source 5 and is used as a transmission antenna, the loop antenna may be connected to a reception circuit instead of the signal source 5 and be used as a reception antenna.

In this case, a magnetic field received from the outside causes a large AC current I2 to be accumulated in the amplification loop 2. Moreover, since there is mutual inductance, the AC current I1 flowing through the main loop 1 is larger than that in the case where there is no amplification loop 2. I1 can be maximized by setting R1, R2, C1, and C2 depending on the frequency, the shape of the loop, and the like. The area of the magnetic field can be thereby increased also for the other party.

Thus, the loop antenna in the first embodiment can increase the area of the radio system utilizing the magnetic field.

Note that the amplification loop 2 may be arranged outside the main loop 1. In other words, the loops are arranged such that one loop includes the other loop therein. The same applies to the embodiments to be described later. As illustrated in FIG. 1, the amplification loop 2 has the same shape (geometric shape) as the main loop. The same shape includes a similar shape. The same applies to the embodiments to be described later.

When a desired current or area can be obtained, one or plurality of R1, R2, C1, and C2 may not be used. The same applies to the embodiments to be described later.

Second Embodiment

Figure 2:
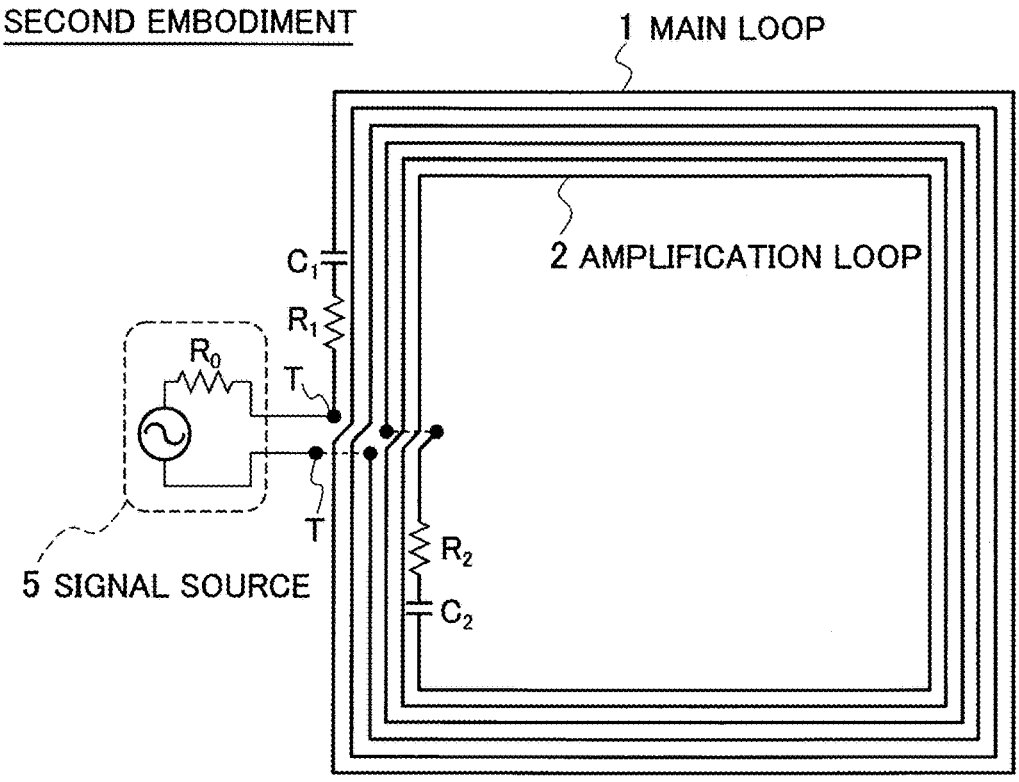
FIG. 2 is a diagram illustrating an example of a loop antenna in a second embodiment.

FIG. 2 is a diagram illustrating an example of a loop antenna in a second embodiment.

In the first embodiment, the number of turns is one in both of the main loop 1 and the amplification loop 2. However, in the second embodiment, the number of turns is three in both loops. Other configurations are the same as those in the first embodiment. The amplification loop 2 is arranged inside the main loop 1.

The number of turns in the present invention is arbitrary and any number of turns is effective. The number of turns may vary between the main loop 1 and the amplification loop 2. However, when the number of turns is two or more, equalizing the number of turns in the main loop 1 and the number of turns in the amplification loop 2 can increase the mutual inductance and thus increase the effect of amplifying the current. Accordingly, it is preferable to equalize the number of turns in the main loop 1 and the number of turns in the amplification loop 2.

Third Embodiment

Figure 3:
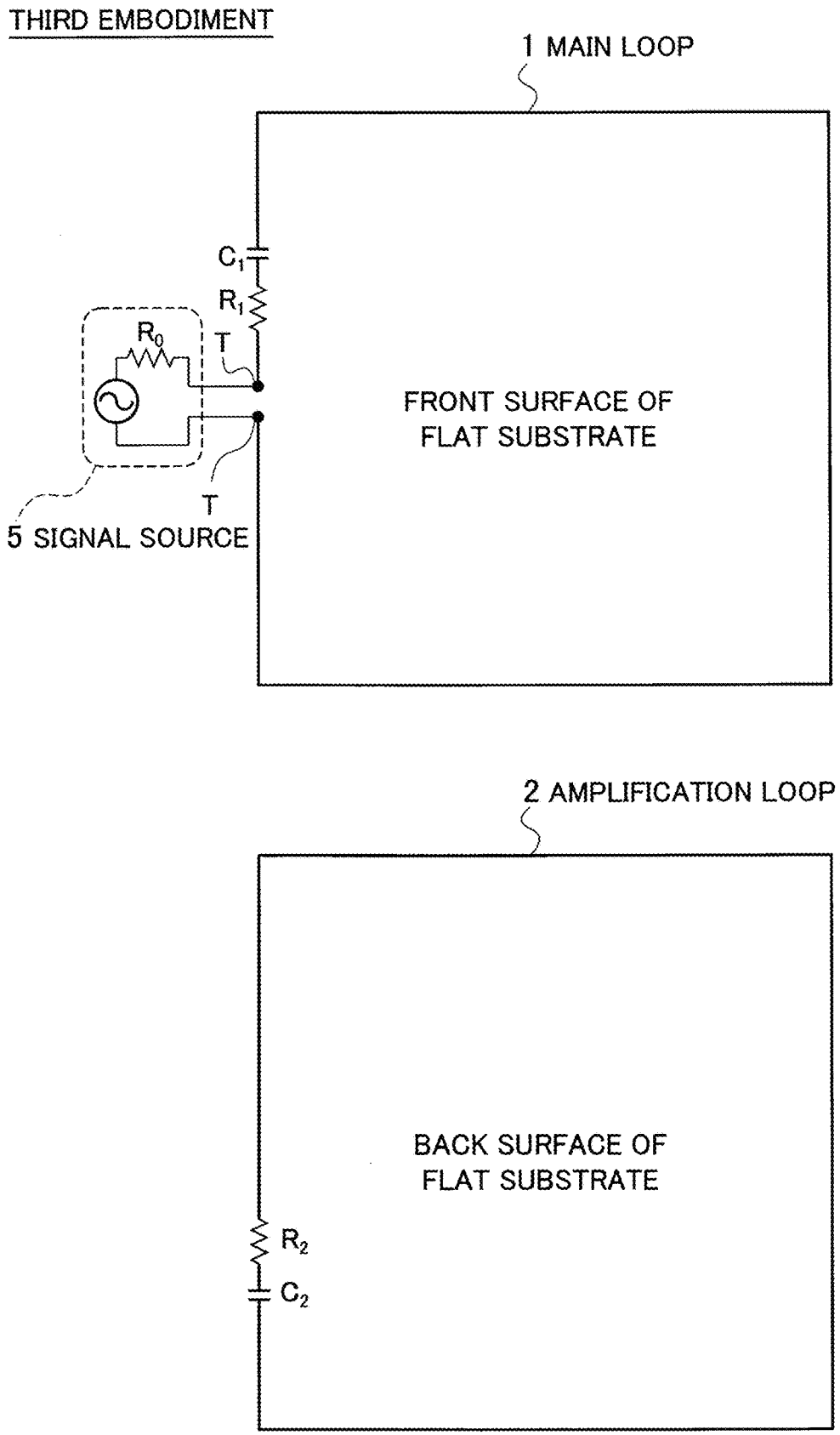
FIG. 3 is a diagram illustrating an example of a loop antenna in a third embodiment.

FIG. 3 is a diagram illustrating an example of a loop antenna in a third embodiment.

In the first and second embodiments, the main loop 1 and the amplification loop 2 are provided on the same flat surface of the flat substrate and the amplification loop 2 is arranged inside or outside the main loop 1 to be provided close thereto.

In the third embodiment, the main loop 1 is formed on a front surface of the flat substrate and the amplification loop 2 is formed on a back surface of the same flat substrate. Other configurations are the same as those in the first embodiment. The main loop 1 and the amplification loop 2 only needs to be formed separately on the different surfaces (front and back surfaces) of the flat substrate. Accordingly, the configuration may be such that the main loop 1 is formed on the back surface of the flat substrate and the amplification loop 2 is formed on the front surface of the same flat substrate.

Forming the main loop 1 and the amplification loop 2 respectively on the front and back surfaces of the same flat substrate allows the main loop 1 and the amplification loop 2 to have the same shape and also to be provided close to each other. In this case, the main loop 1 and the amplification loop 2 can have the same shape and the same size, that is exactly the same shape. In this case, the distance between the main loop 1 and the amplification loop 2 is substantially equal to the thickness of the flat substrate. The distance is equal to or smaller than one-tenth of a square root of the area of a region surrounded by the main loop 1 or the amplification loop 2.

Since the main loop 1 and the amplification loop 2 have the same shape, it is possible to achieve the magnetic coupling coefficient close to 1 between the main loop 1 and the amplification loop 2 and increase the mutual inductance. Accordingly, larger I2 can be obtained relative to constant I1 when the signal source 5 is used, and larger I1 can be obtained relative to constant I2 when the reception circuit is used. In other words, the area of the magnetic field can be increased.

Note that, in a structure in which flat substrates are stacked one on top of another, the main loop 1 and the amplification loop 2 may be arranged respectively on different flat substrates. In this case, the distance between the main loop 1 and the amplification loop 2 is substantially equal to any integral multiple (single, double, . . . ) of the thickness of each flat substrate. The distance is equal to or smaller than one-tenth of a square root of the area of a region surrounded by the main loop 1 or the amplification loop 2.

Fourth Embodiment

Figure 4:
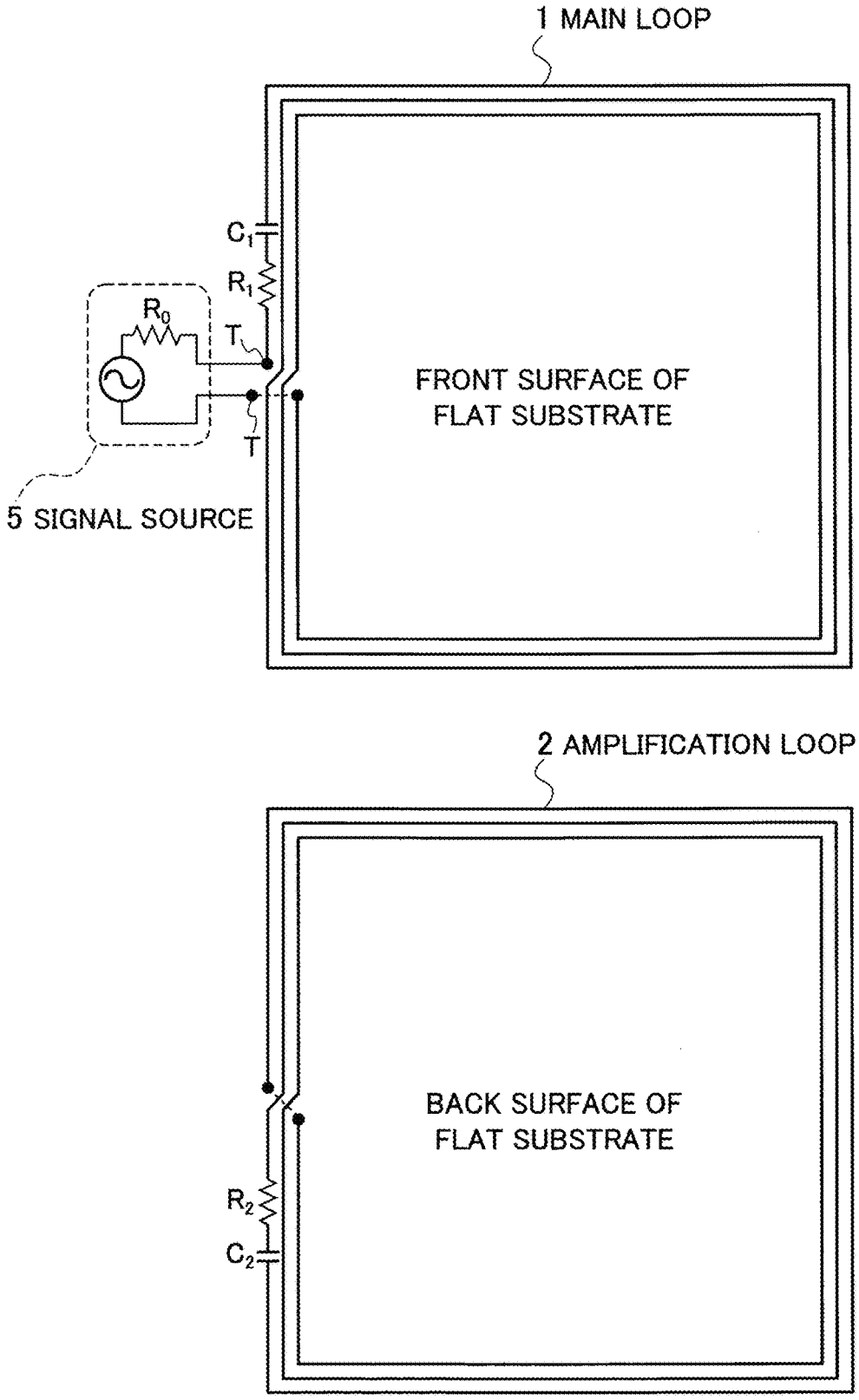
FIG. 4 is a diagram illustrating an example of a loop antenna in a fourth embodiment.

FIG. 4 is a diagram illustrating an example of a loop antenna in a fourth embodiment.

The fourth embodiment has a configuration in which the number of turns is three in the loop antenna of the third embodiment. Other configurations are the same as those in the third embodiment.

As illustrated in FIG. 2, forming the main loop 1 and the amplification loop 2 with many turns on the same surface of the flat substrate has a problem that the difference between the area of the region surrounded by the main loop 1 and the area of the region surrounded by the amplification loop 2 is large. When this difference is too large, the mutual inductance between the main loop 1 and the amplification loop 2 decreases and it is difficult to increase the area of the magnetic field (amplify I2).

In the fourth embodiment, the main loop 1 and the amplification loop 2 are arranged, for example, on the different surfaces of the same flat substrate. Accordingly, the main loop 1 and the amplification loop 2 can be provided close to each other even when the number of turns in each of the main loop 1 and the amplification loop 2 is large. The same applies to the case where the main loop 1 and the amplification loop 2 are arranged on different flat substrates in the structure in which flat substrates are stacked one on top of another.

Thus, the mutual inductance between the main loop 1 and the amplification loop 2 does not decrease and the area of the magnetic field can be increased. This effect can be increased by increasing the number of turns.

Equalizing the number of turns in the main loop 1 and the number of turns in the amplification loop 2 can further increase the mutual inductance and increase the area of the magnetic field.

Fifth Embodiment

The loop antenna in a fifth embodiment is one in which the capacitances connected to the main loop 1 and the amplification loop 2 are optimized. Other configurations are the same as those in the first to fourth embodiments.

For example, the frequency f of a signal generated by the signal source 5 is 10 MHz, the resistance R1 connected to the main loop 1 is 25Ω, the resistance R2 connected to the amplification loop 2 is 1Ω, and the internal resistance R0 of the signal source 5 is 25Ω. In other words, the resistance R2 is smaller than the sum of the resistance R1 and the internal resistance R0.

The main loop 1 and the amplification loop 2 both have the same self-inductance L of 1 pH.

Since the self-inductance of a loop depends on the geometric shape thereof, the self-inductance of the main loop 1 and the self-inductance of the amplification loop 2 can be easily equalized by forming the main loop 1 and the amplification loop 2 in the same geometric shape.

Figure 5:
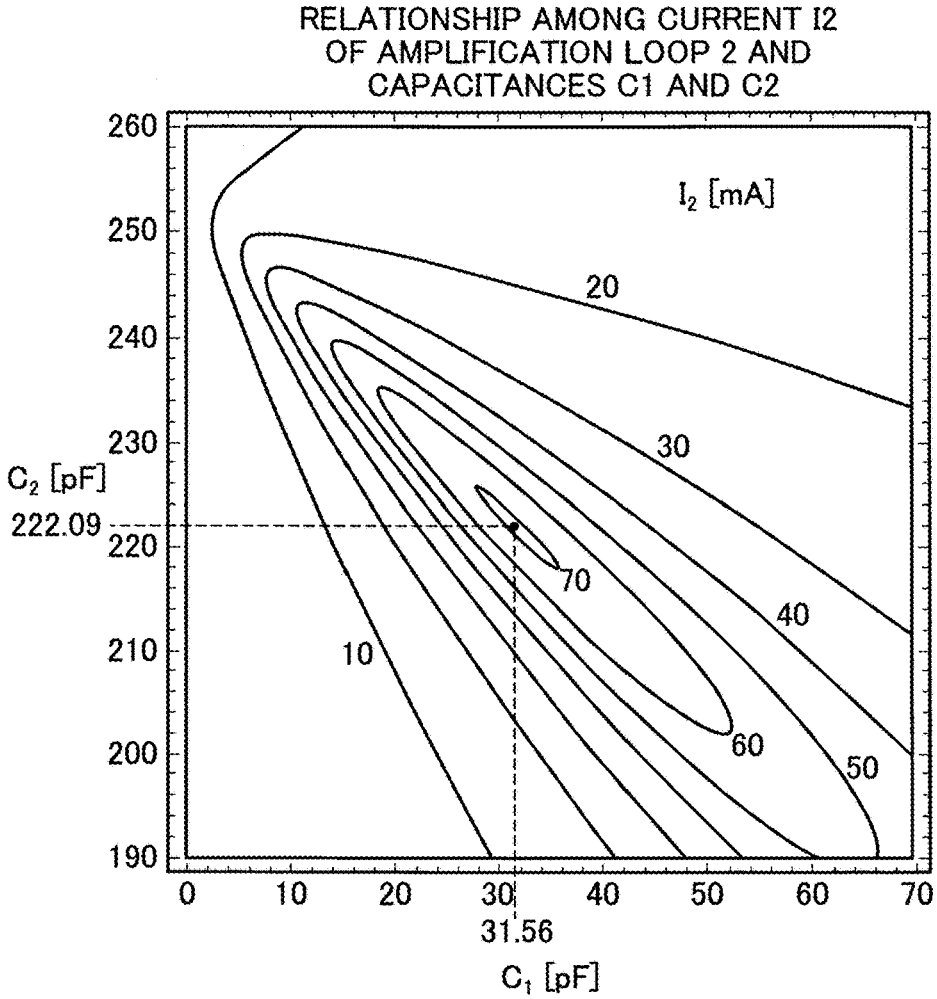
FIG. 5 is a diagram illustrating a relationship among a current I2 of an amplification loop 2 and capacitances C1 and C2.

FIG. 5 is a diagram illustrating a relationship among the current I2 of the amplification loop 2 and the capacitances C1 and C2.

When I2 is simulated under the aforementioned conditions with the capacitances C1 and C2 being variables, the result of FIG. 5 is obtained. I2 is largest when C1 is close to 30 pF and C2 is close to 220 pF.

Meanwhile, when the aforementioned parameters are substituted into the following formulae:

[Math 1]

$$C_1 = \frac{1}{\omega^2 L}\left\{1 + \sqrt{\frac{R_0 + R_1}{R_2} - \left(\frac{R_0 + R_1}{\omega L}\right)^2}\right\}^{-1}$$

$$C_2 = \frac{1}{\omega^2 L}\left\{1 + \sqrt{\frac{R_2}{R_0 + R_1} - \left(\frac{R_2}{\omega L}\right)^2}\right\}^{-1}$$

C1=31.56 [pF] and C2=222.09 [pF] are obtained.

Accordingly, connecting C1 and C2 with the values calculated from these formulae to the main loop 1 and the amplification loop 2 can maximize I2 and provide the maximum amplification effect.

Figure 6:
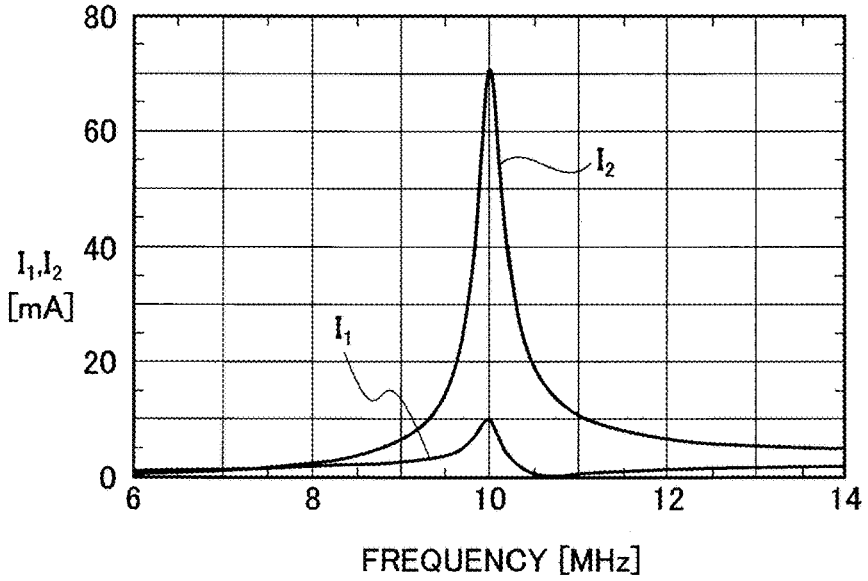
FIG. 6 is a diagram illustrating frequency dependencies (calculation values) of I1 and I2 in the case of C1=31.56 [pF] and C2=222.09 [pF].

FIG. 6 is a diagram illustrating frequency dependencies (calculation values) of I1 and I2 in the case of C1=31.56 [pF] and C2=222.09 [pF].

As illustrated in FIG. 6, the current amplification effect is greatest at 10 MHz. In other words, I1 (power consumption of the signal source 5) is 10 mA while I2 is 70 mA or larger, and a current which is equal to or larger than the seven times the current I1 can flow as I2. The amplitude of the magnetic field which can be generated can be thus amplified to be seven times or more. In other words, since the current flowing through the loop antenna can be amplified without increasing the current supplied from the signal source 5, a large magnetic field can be generated with low power consumption. As a result, the area of the radio system utilizing the magnetic field can be increased.

EXPLANATION OF THE REFERENCE NUMERALS

1 main loop
2 amplification loop
5 signal source
C1, C2 capacitance
I1, I2 current
R0 internal resistance
R1, R2 resistance
T terminal

The invention claimed is:

1. A loop antenna comprising:

a main loop which is an open loop connected to a signal source, wherein an internal resistance is connected to the signal source; and an amplification loop which is a closed loop having a same shape as the main loop, wherein the main loop and the amplification loop are electrically unconnected and are arranged on a same surface of a flat substrate formed of an insulator, a first capacitance and a first resistance are connected to the main loop in series, a second capacitance and a second resistance are connected to the closed loop of the amplification loop in series, and the second resistance is smaller than a sum of the first resistance and the internal resistance.

2. The loop antenna according to claim 1, wherein a distance between the main loop and the amplification loop is equal to or smaller than one-tenth of a square root of an area of a region surrounded by the main loop or the amplification loop.

3. The loop antenna according to claim 1, wherein the number of turns in the main loop is equal to the number of turns in the amplification loop.

4. The loop antenna according to claim 1, wherein the main loop is connected to the signal source, and when self-inductance of the main loop is equal to self-inductance of the amplification loop, the first capacitance C1 of the main loop and the second capacitance C2 of the amplification loop satisfy the following formulae:

$$C_1 = \frac{1}{\omega^2 L}\left\{1 + \sqrt{\frac{R_0 + R_1}{R_2} - \left(\frac{R_0 + R_1}{\omega L}\right)^2}\right\}^{-1}$$

$$C_2 = \frac{1}{\omega^2 L}\left\{1 + \sqrt{\frac{R_2}{R_0 + R_1} - \left(\frac{R_2}{\omega L}\right)^2}\right\}^{-1}$$

where

L is the self-inductance of the main loop and the amplification loop,

ω is an angular frequency of a signal applied to the main loop,

R0 is an internal resistance of the signal source,

R1 is the first resistance, and

R2 is the second resistance.

5. A loop antenna comprising:

a main loop which is an open loop connected to a signal source or a reception circuit; and an amplification loop which is a closed loop having a same shape as the main loop, wherein the main loop and the amplification loop are electrically unconnected and are arranged on different surfaces of a flat substrate formed of an insulator or on different flat substrates in a structure in which a plurality of flat substrates are stacked one on top of another, a first capacitance and a first resistance are connected to the main loop in series, and a second capacitance and a second resistance are connected to the closed loop of the amplification loop in series.

6. The loop antenna according to claim 5, wherein a distance between the main loop and the amplification loop is equal to or smaller than one-tenth of a square root of an area of a region surrounded by the main loop or the amplification loop.

7. The loop antenna according to claim 5, wherein the number of turns in the main loop is equal to the number of turns in the amplification loop.

8. The loop antenna according to claim 2, wherein the main loop is connected to the signal source, and when self-inductance of the main loop is equal to self-inductance of the amplification loop, the first capacitance C1 of the main loop and the second capacitance C2 of the amplification loop satisfy the following formulae:

$$C_1 = \frac{1}{\omega^2 L}\left\{1 + \sqrt{\frac{R_0 + R_1}{R_2} - \left(\frac{R_0 + R_1}{\omega L}\right)^2}\right\}^{-1}$$

$$C_2 = \frac{1}{\omega^2 L}\left\{1 + \sqrt{\frac{R_2}{R_0 + R_1} - \left(\frac{R_2}{\omega L}\right)^2}\right\}^{-1}$$

where

L is the self-inductance of the main loop and the amplification loop,

ω is an angular frequency of a signal applied to the main loop,

R0 is an internal resistance of the signal source,

R1 is the first resistance, and

R2 is the second resistance.

9. The loop antenna according to claim 5, wherein the main loop is connected to the signal source, an internal resistance is connected to the signal source, and the second resistance is smaller than a sum of the first resistance and the internal resistance.

* * * * *